US007397341B2

(12) United States Patent
Bhat et al.

(10) Patent No.: US 7,397,341 B2
(45) Date of Patent: Jul. 8, 2008

(54) SYSTEM TO DETECT LOCK TAMPERING

(75) Inventors: Rajeshwari Bhat, Bangalore Karnataka (IN); Dinesh Kumar K N, Bangalore (IN); Francis C V Saju, Bangalore (IN)

(73) Assignee: Honeywell International, Inc., Morristown, NJ (US)

( * ) Notice: Subject to any disclaimer, the term of this patent is extended or adjusted under 35 U.S.C. 154(b) by 113 days.

(21) Appl. No.: 11/403,479

(22) Filed: Apr. 13, 2006

(65) Prior Publication Data

US 2007/0241859 A1 Oct. 18, 2007

(51) Int. Cl.
*G08B 29/00* (2006.01)

(52) U.S. Cl. ..... 340/5.1; 340/5.6; 340/5.74; 340/426.16; 340/542; 307/10.2

(58) Field of Classification Search ..... 340/425.5, 340/429, 426.3, 426.28, 426.36, 426.11, 340/426.16, 989, 541, 542, 5.72, 825.19, 340/825.72, 5.1, 5.61, 5.6, 407.2, 5.74; 307/10.2, 307/10.3, 10.5, 10.1, 103; 180/287, 173; 70/336, 339, 456 R See application file for complete search history.

(56) References Cited

U.S. PATENT DOCUMENTS

| | | | | |
|---|---|---|---|---|
| 4,186,578 | A | 2/1980 | Sommer | |
| 4,931,664 | A * | 6/1990 | Knoll | 307/103 |
| 5,208,579 | A | 5/1993 | Tseng | |
| 5,266,923 | A | 11/1993 | Tseng | |
| 6,095,415 | A * | 8/2000 | Shouji | 235/449 |
| 6,420,967 | B1 * | 7/2002 | Ghabra et al. | 340/447 |
| 6,608,555 | B1 | 8/2003 | Chang | |
| 6,675,617 | B2 | 1/2004 | Stemmerik | |
| 6,791,456 | B2 * | 9/2004 | Nakayama et al. | 340/429 |

* cited by examiner

*Primary Examiner*—Anh V. La
(74) *Attorney, Agent, or Firm*—Schwegman, Lundberg & Woessner, P.A.

(57) ABSTRACT

A lock and key system is configured to sense an operational signature generated by an object placed into a keyway in the system. The system is further configured to compare the operational signature with a reference signature, and to generate an alarm when the operational signature differs from the reference signature by a threshold.

19 Claims, 3 Drawing Sheets

SYSTEM TO DETECT LOCK TAMPERING

TECHNICAL FIELD

Various embodiments relate to the field of security systems, and in an embodiment, but not by way of limitation, to a system and method for the detection of tampering with locks.

BACKGROUND

Security systems for both homes and businesses is a multi-million dollar industry, and the traditional lock and key system remains a major segment of that industry. While such traditional systems may be configured to sound an alert when an unauthorized entry has occurred, such systems do not emit an alarm before the entry has occurred, such as during an initial act of tampering with the lock. The security industry, business owners, and home owners would benefit from a security system that recognizes an attempted breach of a home or business by tampering or other means.

SUMMARY

A lock and key system is configured to sense an operational signature generated by an object placed into a keyway in the system. The system is further configured to compare the operational signature with a reference signature, and to generate an alarm when the operational signature differs from the reference signature by a threshold.

DETAILED DESCRIPTION

Figure 1:
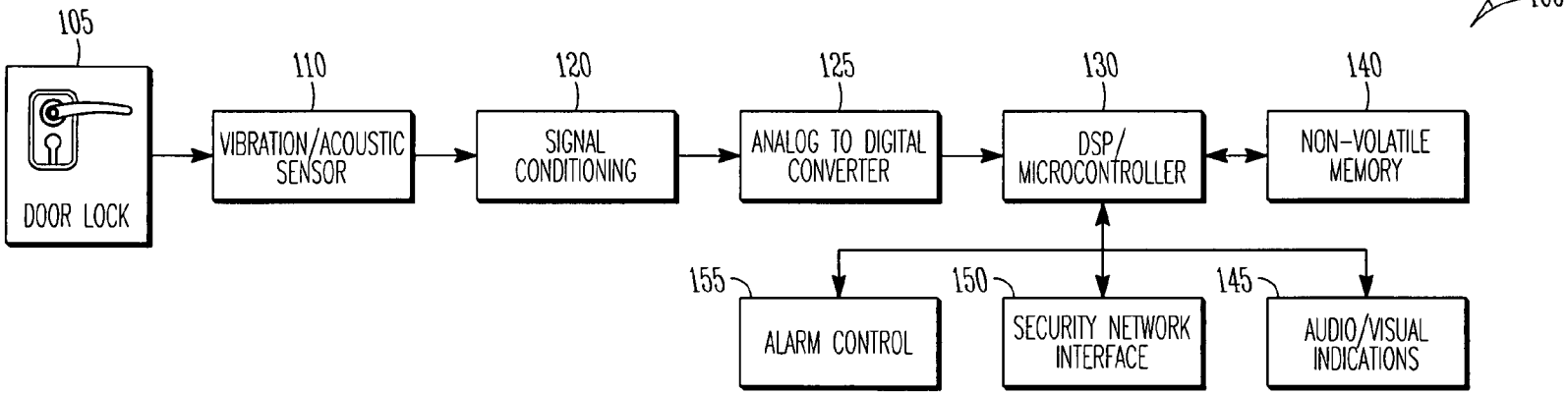
FIG. 1 illustrates an example embodiment of a system to detect tampering events in a security system.

In the following detailed description, reference is made to the accompanying drawings that show, by way of illustration, specific embodiments in which the invention may be practiced. These embodiments are described in sufficient detail to enable those skilled in the art to practice the invention. It is to be understood that the various embodiments of the invention, although different, are not necessarily mutually exclusive. Furthermore, a particular feature, structure, or characteristic described herein in connection with one embodiment may be implemented within other embodiments without departing from the scope of the invention. In addition, it is to be understood that the location or arrangement of individual elements within each disclosed embodiment may be modified without departing from the scope of the invention. The following detailed description is, therefore, not to be taken in a limiting sense, and the scope of the present invention is defined only by the appended claims, appropriately interpreted, along with the full range of equivalents to which the claims are entitled. In the drawings, like numerals refer to the same or similar functionality throughout the several views.

Embodiments of the invention include features, methods or processes embodied within machine-executable instructions provided by a machine-readable medium. A machine-readable medium includes any mechanism which provides (i.e., stores and/or transmits) information in a form accessible by a machine (e.g., a computer, a network device, a personal digital assistant, manufacturing tool, any device with a set of one or more processors, etc.). In an exemplary embodiment, a machine-readable medium includes volatile and/or non-volatile media (e.g., read only memory (ROM), random access memory (RAM), magnetic disk storage media, optical storage media, flash memory devices, etc.), as well as electrical, optical, acoustical or other form of propagated signals (e.g., carrier waves, infrared signals, digital signals, etc.)).

Such instructions are utilized to cause a general or special purpose processor, programmed with the instructions, to perform methods or processes of the embodiments of the invention. Alternatively, the features or operations of embodiments of the invention are performed by specific hardware components which contain hard-wired logic for performing the operations, or by any combination of programmed data processing components and specific hardware components. Embodiments of the invention include include digital/analog signal processing systems, software, data processing hardware, data processing system-implemented methods, and various processing operations, further described herein.

A number of figures show block diagrams of systems and apparatus for a system to detect lock tampering in accordance with embodiments of the invention. A number of figures show flow diagrams illustrating systems and apparatus for such lock tampering detection systems. The operations of the flow diagrams will be described with references to the systems/apparatuses shown in the block diagrams. However, it should be understood that the operations of the flow diagrams could be performed by embodiments of systems and apparatus other than those discussed with reference to the block diagrams, and embodiments discussed with reference to the systems/apparatus could perform operations different than those discussed with reference to the flow diagrams.

A lock and key system, like any mechanical system, generates a certain amount of vibration during operation due to frictional contact of the components of the system, wear and tear, and other factors. Each part of such a system will generate its own vibration component, and the resulting vibration of the entire system will be a complex composite of all the vibrations in the whole mechanical system. Indeed, the amplitude and frequency range of the generated acoustics and vibrations will depend on the type of motion and the complexity of the mechanical system.

The complex vibration signature generated by any particular mechanical system will depend on the components in the system and will be unique in nature depending upon the type of operation performed. There are well known mechanisms to analyze these vibrations in a system, such as by transforming the vibration frequencies into the frequency domain via a Fournier transform. In the frequency domain, the analysis becomes much simpler, and digital filters may be easily employed to remove unwanted components. For example, the system may be able to filter out unwanted vibration components such as someone knocking on the door. In a typical lock and key system, the frequency components generated basically fall within the 2 to 20 KHz range, which is generally the acoustic range of frequencies, and hence a signature of a lock and key system may be termed an acoustic signature.

A conventional lock is a source of operational vibrations just like any other mechanical system. The analysis of these frequency and amplitude components helps to provide hints about the operations occurring inside the mechanical lock. A lock has a unique combination of pins and levers, and when a lock is turned by a key for the purposes of locking or unlocking, a unique set of frequency components is generated. The generated frequency components will depend on a number of parameters such as the type of lock, size of the lock, the cylinders in the lock, the pins and levers, materials used to construct the lock and key, and the manner is which the lock is assembled. However, for any particular lock and key combination, the frequency components remain more or less the same for each locking and unlocking operation.

One or more embodiments take advantage of the consistency of the frequency components of a particular lock and key or a particular key and lock system. Therefore, if an unauthorized person attempts to open a lock with a different key or some sort of tool (which tries to open the lock through the manipulation of the pins in the lock), a different set of vibration components will be produced (as compared to the vibration components produced by the matching key for this lock). Moreover, the time that it takes to pick a lock is generally longer than the time that it takes the lock to be opened with its matching key. In short, the overall vibration signal or acoustic signature that is generated by attempts to pick a lock will be different than those generated by operation of the lock with the matching key. Consequently, a system that can differentiate these signatures can detect a lock picking attempt.

In an embodiment, the vibration signature for a particular lock and key combination is sensed and stored in a memory, and this signature is compared to any later vibration signatures produced by placing an object into the keyway—whether it is the matching key or some other object. If the instantly generated signature does not correlate with the stored signature, then a lock picking attempt has been identified. If the instantly generated signature matches the stored signature, then it is the matching key that has been placed into the keyway. In a finely tuned system, even the differences between the matching key and a master key can be identified.

In an embodiment, a vibration sensor (e.g., a piezoelectric crystal) is mounted onto the frame of a lock (or in proximity to the lock). The vibration sensor may sense any vibrations caused by the insertion of an object into the keyway and subsequent operations. The sensor is connected to a data acquisition circuit, which conditions and digitizes the signal. An embodiment of a data acquisition circuit 100 is illustrated in FIG. 1. FIG. 1 illustrates a sensor device 110 mounted on a door lock 105. The output of the sensor 110 is coupled to signal conditioning circuitry 120 which provides filtering, amplification, wave shaping, and other signal processing functions, and the signal conditioning circuitry 120 is coupled to an analog to digital (A/D) converter 125. The analog input to the A/D converter 125 is signal conditioned to minimize the distortion of the digitized signal contents. The output of the A/D converter 125 is fed to a digital signal processing (DSP)/microcontroller unit 130. The DSP 130 may be an embedded module with all resources integrated at the chip level or board level so that it is self-sufficient. The DSP 130 performs a Fournier analysis of the signal to generate a frequency domain. The DSP 130 has access to a non-volatile memory 140, and an audio/visual indications module 145, a security network interface 150, and an alarm control 155. The audio/visual indications module provides alert to an end user of the system 100, and the security network interface 150 propagates information to a security network.

The DSP 130 performs block transforms on the digitized data to transform the vibration signature into the frequency domain. Once the incoming signal is Fournier transformed, a controller can determine the dominant frequencies that exist in the complex input signal. In an embodiment, the signal is filtered to extract the set of frequency components which remains more or less unchanged during normal lock and key operations. This set of frequency components with their respective amplitudes can be named the "frequency signature."

Figure 2:
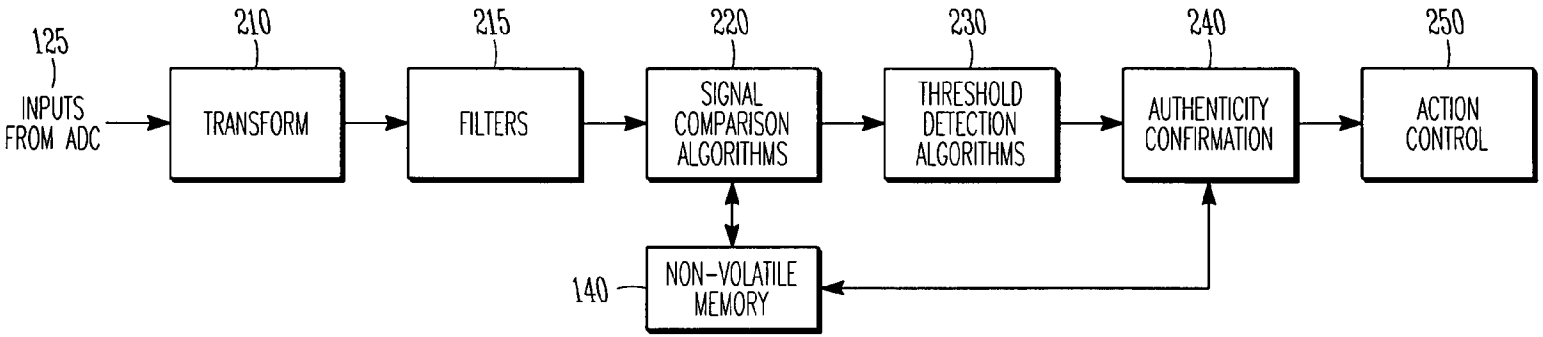
FIG. 2 illustrates an example embodiment of modules in a digital signal processor.

The DSP 130, in an embodiment, stores the vibration signature of the matching lock and key, i.e. the "true signature", in the non-volatile or Flash memory 140. This signature is stored after a true signature is determined after a set of trials. Referring to FIG. 2, an embodiment of a DSP block design illustrates that after the signal from the A/D converter 125 is transformed at 210 and filtered at 215, a signature comparison module 220 compares the true signature that is stored in non-volatile memory 140 with the vibration signature generated by an object being put into the keyway (operational vibration signature). Any lock picking attempt will in all likelihood follow a trial and error type of pattern, and will generate extra vibration components. The use of the wrong key will be detectable since it will generate a different vibration signature than the correct key does.

Referring back to FIG. 2, a threshold detection algorithm 230 analyzes the output from the signature comparison module 220. In an embodiment, the threshold level is a programmable parameter, and may be changed to suit such things as the operational environment and the type of installation. The programmable threshold will help to reduce false alarms. The output from the threshold detector 230 is input into an authenticity module 240. This authenticity module 240 confirms the authentication of the operation based on the output given by the threshold detector 230. For example, if the system is capable of detecting multiple user keys (such as normal key and master key), the authenticity module 240 is the one which can identify the key used and log the details to the non volatile memory 140. The authenticity module 240 is coupled to the action control module 250, which triggers an alarm or generates an alert message across a security network.

Figure 3:
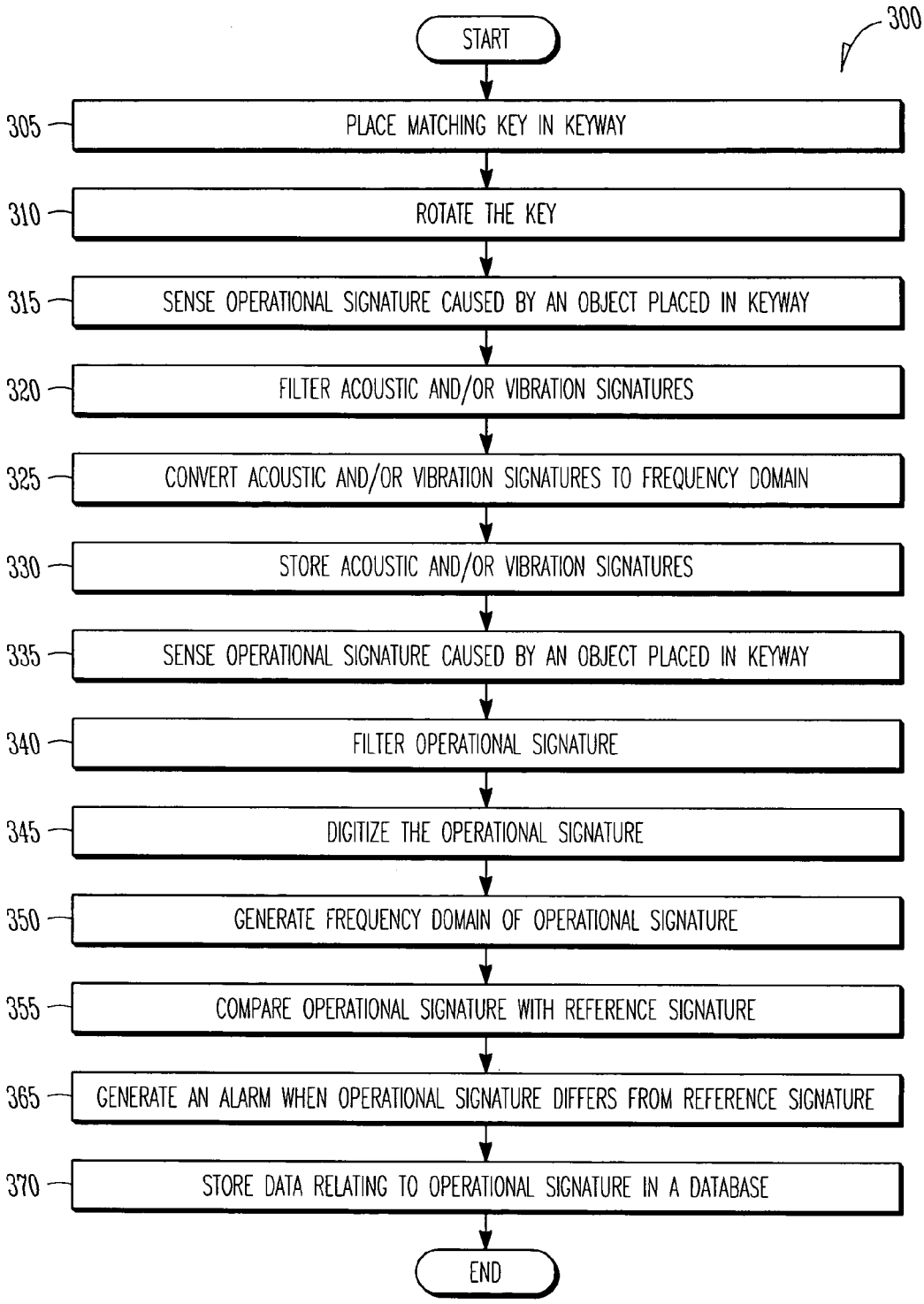
FIG. 3 is an example embodiment of a process to detect tampering events in a security system.

FIG. 3 illustrates another embodiment of a process 300 to capture the vibration and/or acoustic signature of a lock and key system, and to use this signature to detect lock tampering events. It should be noted that FIG. 3 illustrates one embodiment of a process to sense and detect lock tampering, and that all the steps enumerated in FIG. 3 are not required to be present in every embodiment of such a system. Referring now specifically to FIG. 3, a matching key is placed into a keyway at operation 305. The key is rotated at operation 310. At operation 315, one or more acoustic signatures and/or vibration signatures caused by the key rotation are sensed. The one or more acoustic signatures and/or vibration signatures are filtered at operation 320, and thereafter converted to the frequency domain at operation 325. The one or more acoustic signatures and/or vibration signatures are stored in memory at operation 330. These stored signatures may be referred to as the true signatures or reference signatures.

After the sensing and storing of the references signature, the lock and key system is configured to sense a signature (may be referred to as the operational signature) generated by an object placed into the keyway at operation 335, compare the operational signature with the reference signature at operation 355, and generate an alarm when the operational signature differs from said reference signature by a threshold at operation 365. Before the comparison, the system may be configured to generate a frequency domain of said operational signature at 350. Further, in an embodiment, the comparison of the operational signature and the reference signature includes a pattern matching of the operational signature with the reference signature within the frequency domain at operation 355. In another embodiment, the comparison of the operational signature and reference signature includes filtering the operational signature at 340, digitizing the operational signature at 345. The digitized signal to a time optimized signature may also be compared with the reference signature.

In an embodiment, data relating to the operational signature is stored in a database at operation 370. Such data may include the signature itself, and the time and date that the signature was generated.

Over time, because of wear and tear, the true signature of a lock and key mechanism will change. Therefore, in an embodiment, a mode is provided which allows a person to update the true signature. To do so, the lock is placed into the update mode, and the matching key is used to open the lock. The signature is sensed, processed, and stored in the non-volatile memory, thereby providing an updated true signature. An auto update is also possible, for example, by replacing the true signature with the operational vibration after confirming that the operational vibration was generated by the matching key. Since the mechanical wear and tear of a lock and key system is a slow process, the auto update may be performed by the system at pre-specified intervals, which will reduce system overhead.

In another embodiment, the system can store several true signatures if several matching keys are in use in a particular lock and key system. In yet another embodiment, the system can also be made as a portable lock tampering detector which is installable in a short time to any door lock. Such portable systems are helpful during travel.

Figure 4:
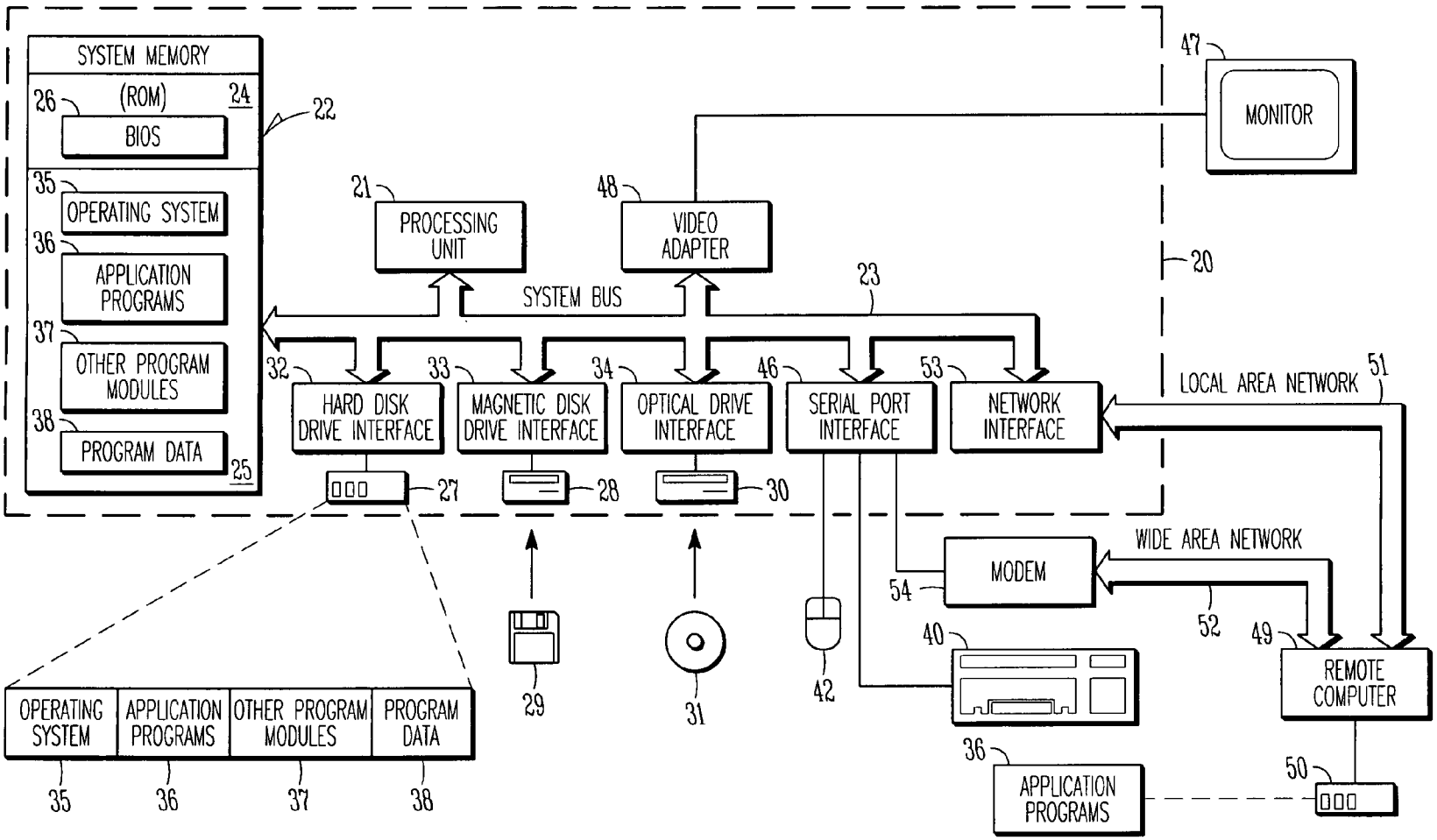
FIG. 4 is an example embodiment of a computer system in connection with which one or more embodiments of a security system may operate.

FIG. 4 is an overview diagram of a hardware and operating environment in conjunction with which embodiments of the invention may be practiced. The description of FIG. 4 is intended to provide a brief, general description of suitable computer hardware and a suitable computing environment in conjunction with which the invention may be implemented. In some embodiments, the invention is described in the general context of computer-executable instructions, such as program modules, being executed by a computer, such as a personal computer. Generally, program modules include routines, programs, objects, components, data structures, etc., that perform particular tasks or implement particular abstract data types.

Moreover, those skilled in the art will appreciate that the invention may be practiced with other computer system configurations, including hand-held devices, multiprocessor systems, microprocessor-based or programmable consumer electronics, network PCS, minicomputers, mainframe computers, and the like. The invention may also be practiced in distributed computer environments where tasks are performed by I/O remote processing devices that are linked through a communications network. In a distributed computing environment, program modules may be located in both local and remote memory storage devices.

In the embodiment shown in FIG. 4, a hardware and operating environment is provided that is applicable to any of the servers and/or remote clients shown in the other Figures.

As shown in FIG. 4, one embodiment of the hardware and operating environment includes a general purpose computing device in the form of a computer 20 (e.g., a personal computer, workstation, or server), including one or more processing units 21, a system memory 22, and a system bus 23 that operatively couples various system components including the system memory 22 to the processing unit 21. There may be only one or there may be more than one processing unit 21, such that the processor of computer 20 comprises a single central-processing unit (CPU), or a plurality of processing units, commonly referred to as a multiprocessor or parallel-processor environment. In various embodiments, computer 20 is a conventional computer, a distributed computer, or any other type of computer.

The system bus 23 can be any of several types of bus structures including a memory bus or memory controller, a peripheral bus, and a local bus using any of a variety of bus architectures. The system memory can also be referred to as simply the memory, and, in some embodiments, includes read-only memory (ROM) 24 and random-access memory (RAM) 25. A basic input/output system (BIOS) program 26, containing the basic routines that help to transfer information between elements within the computer 20, such as during start-up, may be stored in ROM 24. The computer 20 further includes a hard disk drive 27 for reading from and writing to a hard disk, not shown, a magnetic disk drive 28 for reading from or writing to a removable magnetic disk 29, and an optical disk drive 30 for reading from or writing to a removable optical disk 31 such as a CD ROM or other optical media.

The hard disk drive 27, magnetic disk drive 28, and optical disk drive 30 couple with a hard disk drive interface 32, a magnetic disk drive interface 33, and an optical disk drive interface 34, respectively. The drives and their associated computer-readable media provide non volatile storage of computer-readable instructions, data structures, program modules and other data for the computer 20. It should be appreciated by those skilled in the art that any type of computer-readable media which can store data that is accessible by a computer, such as magnetic cassettes, flash memory cards, digital video disks, Bernoulli cartridges, random access memories (RAMs), read only memories (ROMs), redundant arrays of independent disks (e.g., RAID storage devices) and the like, can be used in the exemplary operating environment.

A plurality of program modules can be stored on the hard disk, magnetic disk 29, optical disk 31, ROM 24, or RAM 25, including an operating system 35, one or more application programs 36, other program modules 37, and program data 38. A plug in containing a security transmission engine for the present invention can be resident on any one or number of these computer-readable media.

A user may enter commands and information into computer 20 through input devices such as a keyboard 40 and pointing device 42. Other input devices (not shown) can include a microphone, joystick, game pad, satellite dish, scanner, or the like. These other input devices are often connected to the processing unit 21 through a serial port interface 46 that is coupled to the system bus 23, but can be connected by other interfaces, such as a parallel port, game port, or a universal serial bus (USB). A monitor 47 or other type of display device can also be connected to the system bus 23 via an interface, such as a video adapter 48. The monitor 40 can display a graphical user interface for the user. In addition to the monitor 40, computers typically include other peripheral output devices (not shown), such as speakers and printers.

The computer 20 may operate in a networked environment using logical connections to one or more remote computers or servers, such as remote computer 49. These logical connections are achieved by a communication device coupled to or a part of the computer 20; the invention is not limited to a particular type of communications device. The remote computer 49 can be another computer, a server, a router, a network PC, a client, a peer device or other common network node, and typically includes many or all of the elements described above I/O relative to the computer 20, although only a memory storage device 50 has been illustrated. The logical connections depicted in FIG. 4 include a local area network (LAN) 51 and/or a wide area network (WAN) 52. Such networking environments are commonplace in office networks, enterprise-wide computer networks, intranets and the internet, which are all types of networks.

When used in a LAN-networking environment, the computer 20 is connected to the LAN 51 through a network interface or adapter 53, which is one type of communications device. In some embodiments, when used in a WAN-networking environment, the computer 20 typically includes a modem 54 (another type of communications device) or any other type of communications device, e.g., a wireless transceiver, for establishing communications over the wide-area network 52, such as the internet. The modem 54, which may be internal or external, is connected to the system bus 23 via the serial port interface 46. In a networked environment, program modules depicted relative to the computer 20 can be stored in the remote memory storage device 50 of remote computer, or server 49. It is appreciated that the network connections shown are exemplary and other means of, and communications devices for, establishing a communications link between the computers may be used including hybrid fiber-coax connections, T1-T3 lines, DSL's, OC-3 and/or OC-12, TCP/IP, microwave, wireless application protocol, and any other electronic media through any suitable switches, routers, outlets and power lines, as the same are known and understood by one of ordinary skill in the art.

In the foregoing detailed description of embodiments of the invention, various features are grouped together in one or more embodiments for the purpose of streamlining the disclosure. This method of disclosure is not to be interpreted as reflecting an intention that the claimed embodiments of the invention require more features than are expressly recited in each claim. Rather, as the following claims reflect, inventive subject matter lies in less than all features of a single disclosed embodiment. Thus the following claims are hereby incorporated into the detailed description of embodiments of the invention, with each claim standing on its own as a separate embodiment. It is understood that the above description is intended to be illustrative, and not restrictive. It is intended to cover all alternatives, modifications and equivalents as may be included within the scope of the invention as defined in the appended claims. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein," respectively. Moreover, the terms "first," "second," and "third," etc., are used merely as labels, and are not intended to impose numerical requirements on their objects.

The abstract is provided to comply with 37 C.F.R. 1.72(b) to allow a reader to quickly ascertain the nature and gist of the technical disclosure. The Abstract is submitted with the understanding that it will not be used to interpret or limit the scope or meaning of the claims.

The invention claimed is:

1. A method comprising:

configuring a lock and key system to sense an operational signature generated by an object placed into a keyway of said lock and key system;

configuring said system to compare said operational signature with a reference signature; and configuring said system to generate an alarm when said operational signature differs from said reference signature by a threshold;

wherein said operational signature is one or more of a vibration signature and an acoustic signature.

2. The method of claim 1, wherein data relating to said operational signature is stored in a database.

3. The method of claim 1, wherein said comparing is further configured to:

condition and filter said operational signature;

digitize said operational signature;

convert said digitized signature into a frequency domain; and subject said digitized signature to a time frame optimized signature comparison within a comparable frequency domain.

4. The method of claim 3, wherein said time frame optimized signature comparison includes pattern matching of said operational signature with said reference signature within said time frame.

5. The method of claim 1, wherein said reference signature is generated by:

placing a matching key into said keyway;

rotating said matching key in said keyway;

sensing one or more of an acoustic signature and a vibration signature caused by said rotating of said matching key;

filtering one or more of said acoustic signature and said vibration signature generated by said matching key;

converting one or more of said acoustic signature and said vibration signature generated by said matching key to a frequency domain; and storing said frequency domain of said one or more of said acoustic signature and said vibration signature.

6. The method of claim 5, further comprising configuring said lock and key system with an update mode.

7. The method of claim 5, further comprising configuring said lock and key system to generate, store, and process a plurality of reference signatures representing a plurality of matching keys.

8. A system comprising:

a lock and key system;

a lock and key tampering detection system coupled to said lock and key system; and a sensor mounted in proximity to said lock and key system, said sensor electronically coupled to an analog to digital converter through a signal conditioning unit;

wherein said sensor is configured to sense an acoustic or vibration-based operational signature generated by an object placed into a keyway of said lock and key system.

9. The system of claim 8, wherein said tampering detection system further comprises:

a digital signal processing unit coupled to said analog to digital converter.

10. The system of claim 8, wherein said tampering detection system is portable.

11. The system of claim 9, further comprising an alarm coupled to said digital signal processing unit.

12. The system of claim 9, wherein said sensor includes one or more of a vibration sensor and an acoustic sensor.

13. The system of claim 12, wherein said sensor is a piezoelectric transducer or an electromechanical transducer.

14. The system of claim 8, further comprising a memory to store one or more of a vibration signature and an acoustic signature.

15. The system of claim 9, wherein said digital signal processing unit comprises:

a transform module;

a filter;

a signature comparison module; and a threshold detection algorithm.

16. A machine readable medium comprising instructions to execute a method comprising:

sensing an operational signature in a lock and key system generated by an object placed into a keyway;

comparing said operational signature with a reference signature; and generating an alarm when said operational signature differs from said reference signature by a threshold;

wherein said operational signature is one or more of a vibration signature and an acoustic signature.

17. The machine readable medium of claim 16, further comprising instructions to generate a frequency domain of said operational signature, and further wherein said comparing comprises a pattern matching of said operational signature with said reference signature within said frequency domain.

18. The machine readable medium of claim 16, wherein said comparing further comprises instructions to:

filter said operational signature;

digitize said operational signature;

convert said digitized signature into a frequency domain;

subject said digitized signature to a time optimized signature comparison.

19. The machine readable medium of claim 16, further comprising instructions to generate said reference signature comprising:

placing a matching key into said keyway;

rotating said matching key in said keyway;

sensing one or more of an acoustic signature and a vibration signature caused by said rotating of said matching key;

filtering one or more of said acoustic signature and said vibration signature generated by said matching key;

converting one or more of said acoustic signature and said vibration signature generated by said matching key to a frequency domain; and storing said frequency domain of said one or more of said acoustic signature and said vibration signature.

* * * * *